US011391114B2

(12) United States Patent
Munguia

(10) Patent No.: US 11,391,114 B2
(45) Date of Patent: Jul. 19, 2022

(54) PRESSURE COMPENSATION PISTON FOR DYNAMIC SEAL PRESSURE DIFFERENTIAL MINIMIZATION

(71) Applicant: Halliburton Energy Services, Inc., Houston, TX (US)

(72) Inventor: Joseph Robert Munguia, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/120,654

(22) Filed: Dec. 14, 2020

(65) Prior Publication Data

US 2022/0186580 A1 Jun. 16, 2022

(51) Int. Cl.
*E21B 33/1295* (2006.01)
*E21B 4/00* (2006.01)
*E21B 33/08* (2006.01)

(52) U.S. Cl.
CPC ..... *E21B 33/1295* (2013.01); *E21B 4/003* (2013.01); *E21B 33/085* (2013.01)

(58) Field of Classification Search
CPC ..... E21B 33/1295; E21B 33/085; E21B 4/003
See application file for complete search history.

(56) References Cited

U.S. PATENT DOCUMENTS

| | | | | |
|---|---|---|---|---|
| 3,735,826 | A * | 5/1973 | Constantinescu | E21B 25/00 175/228 |
| 5,195,754 | A | 3/1993 | Dietle | |
| 10,081,983 | B2 | 9/2018 | Kirkhope | |
| 2009/0301780 | A1 | 12/2009 | Gearhart et al. | |
| 2014/0000966 | A1 | 1/2014 | Fuhst et al. | |
| 2020/0263502 | A1 | 8/2020 | Moore et al. | |
| 2020/0308928 | A1 | 10/2020 | Chambers et al. | |

FOREIGN PATENT DOCUMENTS

| | | | | |
|---|---|---|---|---|
| EP | 0105860 | A2 | 4/1984 | |
| WO | 2016053354 | A1 | 4/2016 | |
| WO | WO2019/207398 | A1 * | 10/2019 | E21B 23/08 |

* cited by examiner

*Primary Examiner* — Kristyn A Hall
(74) *Attorney, Agent, or Firm* — Benjamin Ford; Parker Justiss, P.C.

(57) ABSTRACT

Disclosed herein are embodiments of a pressure compensation piston and embodiments of rotary seal assemblies. In one embodiment, a pressure compensation piston for use with a rotary seal assembly includes a stepped piston having an opening extending there through for positioning the stepped piston about a rotatable shaft of a rotary seal assembly. In accordance with this embodiment, the pressure compensation piston further includes a rotary seal positioned along a radial surface of the opening for sealing the stepped piston relative to the rotatable shaft.

17 Claims, 4 Drawing Sheets

PRESSURE COMPENSATION PISTON FOR DYNAMIC SEAL PRESSURE DIFFERENTIAL MINIMIZATION

BACKGROUND

Directional drilling in oil and gas exploration and production has been used to reach subterranean destinations or formations with a drilling string. One type of directional drilling involves rotary steerable drilling systems that allow a drill string to rotate continuously while steering the drill string to a desired target location in a subterranean formation. Rotary steerable drilling systems are generally positioned at a lower end of the drill string and typically include a rotating drill shaft or mandrel, a housing that supports the rotating drill shaft, and additional components that seal a space between the housing and the rotating drill shaft from entry of drilling fluids and other debris. Under normal operating conditions, a pressure differential exists between the annulus pressure and the tool pressure, requiring a specialized rotary seal assembly.

BRIEF DESCRIPTION

Reference is now made to the following descriptions taken in conjunction with the accompanying drawings, in which.

DETAILED DESCRIPTION

Figure 1:
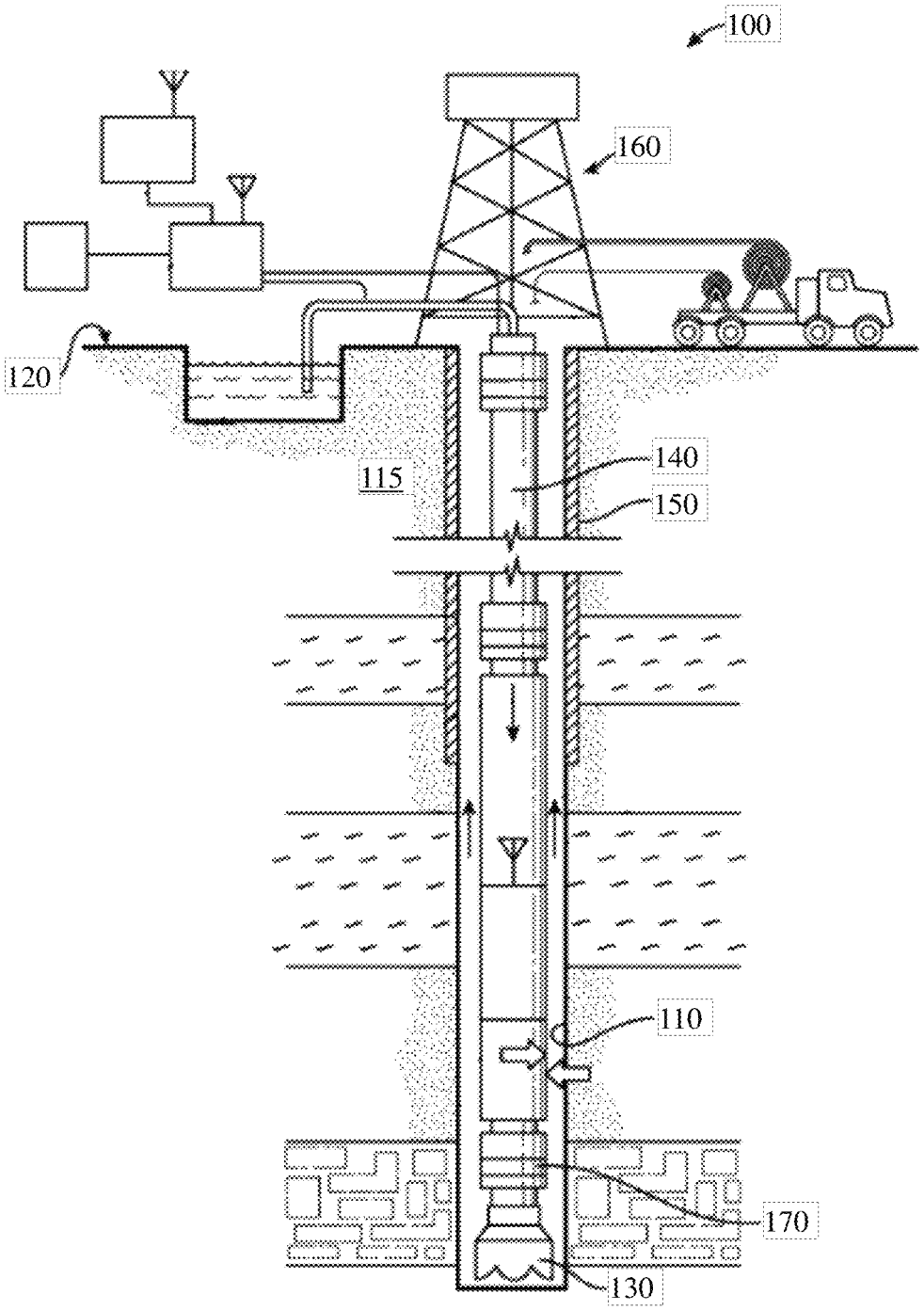
FIG. 1 depicts a well system including an exemplary operating environment that the apparatuses, systems and methods disclosed herein may be employed.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Disclosed, in one embodiment, is a pressure compensation piston for use with a rotary seal assembly. The pressure compensation piston, in one embodiment, may be a stepped piston which rotates relative to a rotatable shaft, while sliding longitudinally along the shaft to compensate for pressure changes that may occur as the rotatable shaft moves downhole in a wellbore. The pressure compensation piston may be used to adjust pressure across a dynamic rotary seal, and in some embodiments may compensate for a high bore pressure and low annulus pressure, as will be discussed herein with calculation examples.

In another embodiment, there is disclosed a rotary seal assembly which may be used with a motor, such as a progressive displacement motor, or mud motor, downhole in a wellbore. The rotary seal assembly may include, in some embodiments, a housing, and a rotatable shaft positioned in a longitudinal opening in the housing, the housing and rotatable shaft forming a cavity there between. Within the cavity may be a radial bearing and a pressure compensation piston, wherein the pressure compensation piston is configured to slide longitudinally relative to the housing. A first dynamic rotary seal may seal the pressure compensation piston relative to the rotatable shaft, and a second dynamic rotary seal may seal the housing relative to the rotatable shaft. In some embodiments, the rotary seal assembly may include an annulus pressure port in the housing, the annulus pressure port configured to couple a pressure source outside of the housing to a stepped up area of the stepped piston.

Referring to FIG. 1, depicted is a well system 100 including an exemplary operating environment that the apparatuses, systems and methods disclosed herein may be employed. The well system 100 is illustrated with a wellbore 110 drilled into the earth 115 from the ground's surface 120 using a drill bit 130 provided on a conveyance 140. For illustrative purposes, the top portion of the wellbore 110 includes surface casing 150, which is typically at least partially comprised of cement and which defines and stabilizes the wellbore 110 after being drilled. The wellbore 110 also may include intermediate casings (not shown), which may be stabilized with cement. The cement performs several functions, including preventing wellbore collapse, maintaining a physical separation between the Earth's layers, providing a barrier to prevent fluid migration, enhancing safety, and protecting the Earth's layers from any contaminants introduced during open-hole operations, or the like.

The drill bit 130 is located proximate the bottom, distal end of the conveyance 140 that supports various components along its length. During open-hole operations, the drill bit 130 and the conveyance 140 are advanced into the earth 115 by a drilling rig 160. The drilling rig 160 may be supported directly on land as illustrated, or on an intermediate platform if at sea.

The drill bit 140 may be coupled with a motor, and may further include a rotary seal assembly 170. The rotary seal assembly 170 may include embodiments of a pressure compensation piston configured to lower pressure across the rotary seal assembly 170. Lowering pressure across the rotary seal assembly 170 may lower fluid loss from the bore to the annulus that may hinder or lesson performance of tools positioned downhole of the rotary seal assembly 170. Certain dynamic rotary seals which may be used in the rotary seal assembly may be configured to withstand certain maximum pressure amounts before function and performance of the dynamic rotary seal may be impaired. Once such seal is a Kalsi seal, as might be purchased from Kalsi Engineering, 745 Park Two Drive, Sugar Land, Tex. 77478. As such, there is a need to reduce pressure acting on certain dynamic rotary seals, such as the Kalsi seal, in order to maintain expected performance of the dynamic rotary seal and prevent failure.

The wellbore 110, which is illustrated extending downhole into the Earth's layers, and any components inside the wellbore 110 are subjected to hydrostatic pressure originating from subterranean destinations or formations. The hydrostatic pressure acting on the conveyance 140 provided inside the wellbore 110 is identified as formation hydrostatic pressure. The hydrostatic pressure originating from within the conveyance 140 is identified as backpressure hydrostatic pressure. As the drilling depth increases, a hydrostatic pressure differential may develop between the outside formation hydrostatic pressure and the backpressure hydrostatic pressure.

Figure 2:
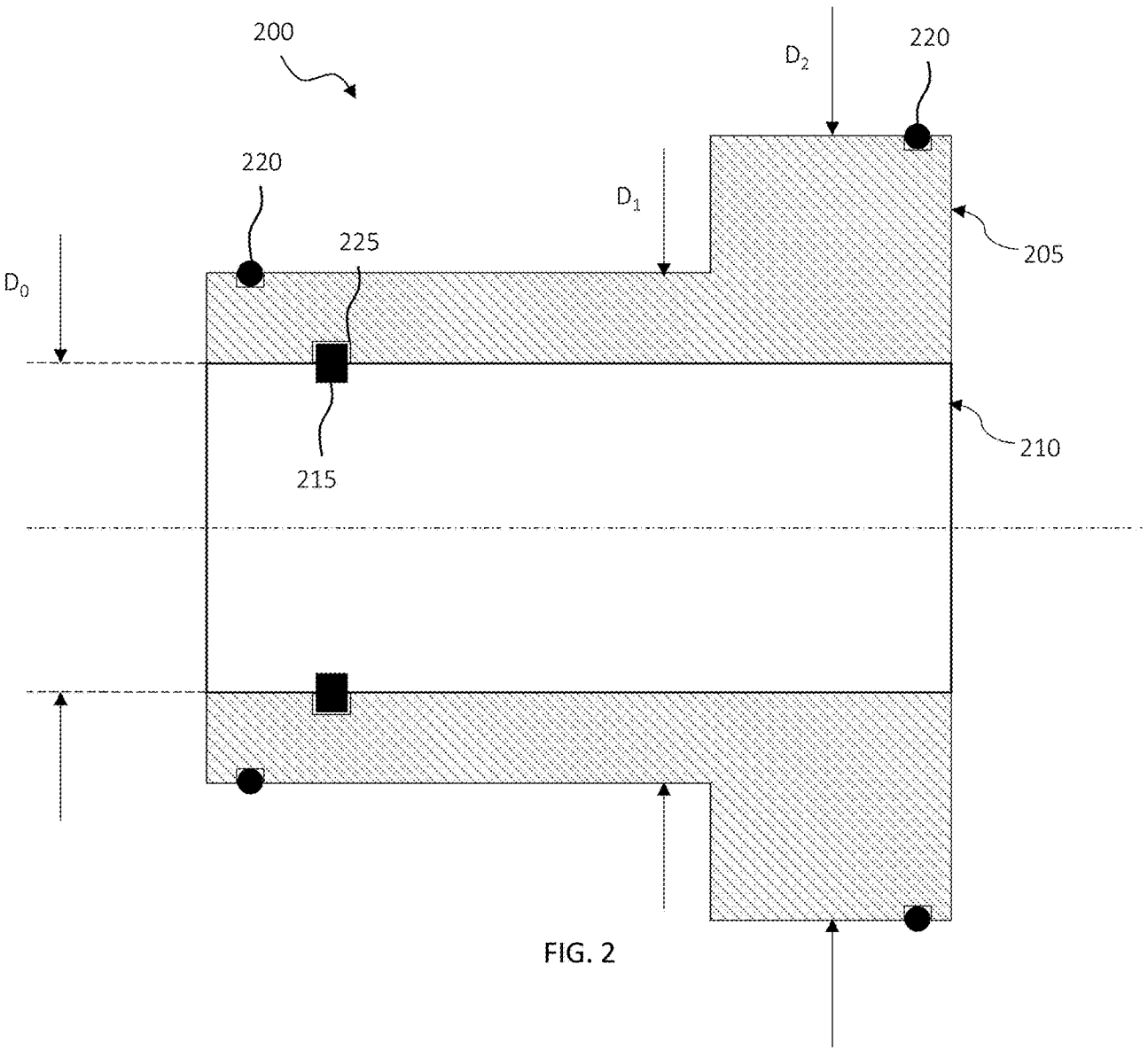
FIG. 2 depicts one embodiment of a pressure compensation piston according to principles of the disclosure, as might be used with a rotary seal assembly.

Referring to FIG. 2, depicted is one embodiment of a pressure compensation piston 200 for use with a rotary seal assembly placed downhole in a wellbore, such as the rotary seal assembly 170 shown in FIG. 1. The pressure compensation piston 200 may be configured to lower the differential pressure over the rotary seal assembly. In some embodiments, the pressure compensation piston 200 may be a stepped piston 205 having an opening extending there through for positioning the stepped piston 205 about a rotatable shaft 210 of a rotary seal assembly. In this embodiment, a rotary seal 215 may be positioned along a radial surface of the opening for sealing the stepped piston 205 relative to the rotatable shaft 210.

In some embodiments, one or more linear dynamic seals 220 may be positioned about the stepped piston 205 for sealing the stepped piston 205 relative to a housing surrounding the pressure compensation piston 200. In some embodiments, the one or more linear dynamic seals 220 may be fixed location seals.

The stepped piston 205 may slide longitudinally (left-right) when acted upon by wellbore pressure and annulus pressure external to the pressure compensation piston 200. The stepped piston 205 may thereby lesson dynamic pressure acting on the dynamic rotary seal 215 and reduce the likelihood of failure over time. The fluid loss from the wellbore may then be reduced and lessen any impact the fluid may have on the performance of tools in the wellbore downhole of the pressure compensation piston 200.

In some embodiments, the opening through the stepped piston 205 may include a diameter ($D_0$). Located in the diameter ($D_0$), in certain embodiments, is a circumferential profile 225 extending radially outward into the stepped piston 205. In this embodiment, the dynamic rotary seal 215 may be positioned within the circumferential profile 225. The stepped piston 205 may also include a first diameter ($D_1$) or first step portion and a second greater diameter ($D_2$) or second step portion, and in this embodiment, the circumferential profile 225 may be located in the first diameter ($D_1$) portion. While the circumferential profile 225 is located in the first diameter ($D_1$) portion in the illustrated embodiment of FIG. 2, other embodiments may exist wherein the circumferential profile 225 is located in the second diameter ($D_2$) portion.

Figure 3:
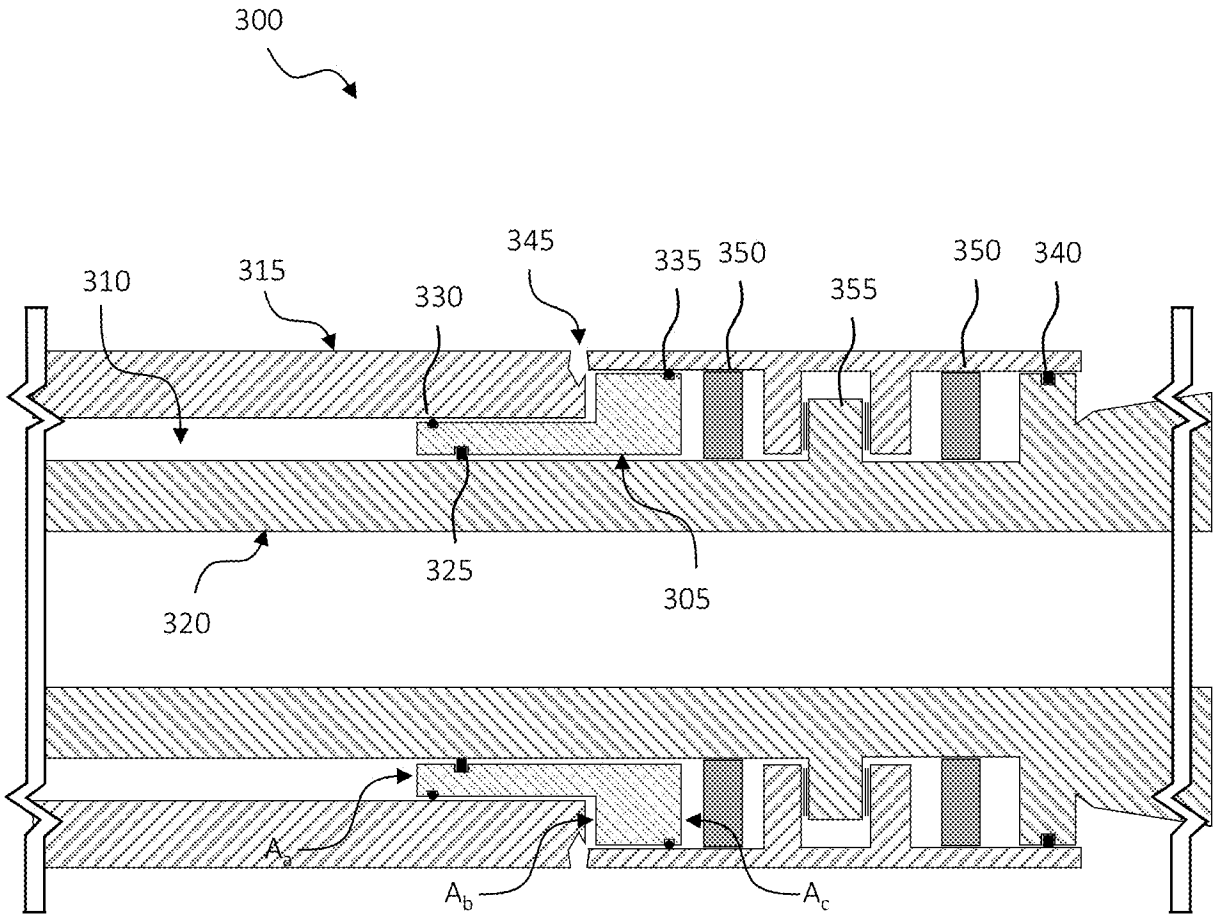
FIG. 3 depicts one embodiment of a rotary seal assembly according to one or more principles of the disclosure.

Referring now to FIG. 3, depicted is an embodiment of a rotary seal assembly 300 designed, manufactured and operated according to the disclosure, which may be used with a motor, such as, e.g., a mud motor. In this embodiment, the rotary seal assembly 300 includes a pressure compensation piston 305 which may be positioned in a cavity 310 formed between a housing 315 and a rotatable shaft 320. The rotatable shaft 320, in the illustrated embodiment, is positioned in a longitudinal opening in the housing 315. The pressure compensation piston 305 may be a stepped piston, similar to stepped piston 205, having an opening extending there through for positioning the pressure compensation piston 305 about the rotatable shaft 320. In some embodiments, the pressure compensation piston 305 may be configured to slide longitudinally (left to right) within the cavity 310 with respect to the housing 315 in response to pressure acting upon the pressure compensation piston 305. The pressure acting upon the pressure compensation piston 305, in some embodiments, may be bore pressure and/or annulus pressure, in certain embodiments.

In some embodiments, a first dynamic rotary seal 325 may be positioned along a radial surface of the opening within the pressure compensation piston 305, for sealing the pressure compensation piston 305 relative to the rotatable shaft 320. In some embodiments, the pressure compensation piston 305 and the housing 315 may be rotationally fixed relative to each other. In some embodiments, there may be a first linear dynamic seal 330 positioned at least partially within a radially exterior surface of the first diameter ($D_1$) portion, to seal the first diameter ($D_1$) portion relative to the housing 315. In other embodiments, there may be a second linear dynamic seal 335 positioned at least partially within a radially exterior surface of the second diameter ($D_2$) portion, to seal the second diameter ($D_2$) portion relative to the housing 315.

The pressure compensation piston 305 and the housing 315 may rotate relative to the rotatable shaft 320, and in this embodiment, a second dynamic rotary seal 340 may be positioned proximate and between an outer radial surface of the rotatable shaft 320 and an inner radial surface of the longitudinal opening of the housing 315, for sealing the rotatable shaft 320 relative to the housing 315.

In some embodiments, the housing 315 may include an annulus pressure port 345 therein, wherein the annulus pressure port 345 may be configured to couple a pressure source outside of the housing 315 proximate a stepped up area $A_C$ of the pressure compensation piston 305. The annulus pressure port 345 may allow fluid flow between the pressure source radially outside of the housing 315 and the cavity 310, and thus add to the left to right (e.g., downward in the illustrated embodiment) force upon the pressure compensation piston 305.

In some embodiments, there may be one or more radial bearings 350 positioned within the cavity 310, wherein the radial bearings 350 may be configured to assist the rotation of the rotatable shaft 320 relative to the housing 315. In certain embodiments, there may be a thrust bearing 355 positioned between the radial bearings 350, wherein the thrust bearing 355, in combination with the radial bearings 350 may be configured to prevent rotatable shaft 320 from sliding longitudinally with respect to the housing 315. In some embodiments, the pressure compensation piston 305 may be positioned uphole of one or both of the radial bearings 350 and the thrust bearing 355. In other embodiments, the pressure compensation piston 305 may be placed in other locations within the cavity 310.

When the bore pressure from the rotatable shaft 320 and annulus pressure from the annulus pressure port 345 act on the pressure compensation piston 305, the pressure compensation piston 305, in some embodiments, slides longitudinally (left to right) with respect to the housing 315, thereby transferring the pressure exerted on the first dynamic rotary seal 325, reducing the bore pressure and the annulus pressure acting on the first dynamic rotary seal 325 and resulting in an intermediate pressure amount between the bore pressure and the annulus pressure. The foregoing pressure compensation is shown in the sample calculations in Table 1 herein.

The pressure compensation piston 305 operates under the law of pressure (P) equals force (F) over area (A), P=F/A. Referring to Table 1 disclosed herein in conjunction with FIG. 2 and FIG. 3, there is shown an example of calculations illustrating the change of pressure across one embodiment of a rotary seal assembly such as rotary seal assembly 300 including one embodiment of the pressure compensation piston 305. The stepped piston comprising the pressure compensation piston 305 may have areas $A_A$, $A_B$, and $A_C$ which may correspond with the diameters $D_0$, $D_1$, and $D_2$ shown in FIG. 2 for stepped piston 205. Embodiments of the pressure compensation piston 305 use the different areas of the piston $A_A$, $A_B$, and $A_C$ to apply a force to a larger area and thereby compensate for higher pressures.

As shown in Table 1, Force 1=Area A ($A_A$)×Pressure 1. Pressure 1, in this embodiment, may be bore pressure. Force 1 may represent the force exerted on the radial surface of the opening within the pressure compensation piston 305 at Area A ($A_A$). Force 2=Area B×Pressure 2. Pressure 2, in this embodiment is may be annulus pressure, as it might be provided by the annulus pressure port 345. Force 2 may represent the force exerted on at least a portion of the radially exterior surface of the second diameter ($D_2$) portion of the pressure compensation piston 305. Force 3=Force 1+Force 2. As shown in Table 1, the pressure at Area 1 ($A_A$) is higher than the pressure at Area 3 ($A_C$). In this example, as the pressure at the piston may then be calculated. Knowing the bore pressure, annulus pressure, and pressure at the piston, the pressure differential across those three features can be calculate. Thus, whereas the pressure differential across the rotary seal 325 would have been 8.28 MPa without the stepped pressure compensation piston 305, the inclusion of the stepped pressure compensation piston 305 reduces the pressure differential across the rotary seal 325 to 3.10 MPa. As such, the pressure exerted on the dynamic rotary seal 315 may be reduced, which may lessen the probability of the rotary seal 315 failing and reduce the amount of fluid leaking from the rotary seal.

TABLE 1

Example of pressure calculations with one pressure compensation piston

| | Piston 1 |
|---|---|
| Bore Pressure (MPa) | 172.41 |
| Annulus Pressure (MPa) | 164.14 |
| Tool Pressure Drop (MPa) | 8.28 |
| Diameter A ($D_0$)(cm) | 2.54 |
| Diameter B ($D_1$)(cm) | 5.08 |
| Diameter C ($D_2$)(cm) | 7.62 |
| Area A ($A_A$)($cm^3$) | 15.19 |
| Area B ($A_B$)($cm^3$) | 25.32 |
| Area C ($A_C$)($cm^3$) | 40.52 |

TABLE 1-continued

Example of pressure calculations with one pressure compensation piston

| | Piston 1 |
|---|---|
| Force 1 (Bore Pressure) | 2620 |
| Force 2 (Annulus Pressure) | 4156 |
| Force 3 (Force 1 + Force 2) | 6776 |
| Pressure at Piston (MPa) | 167.24 |
| Pres Diff Bore-Piston (MPa) | 5.17 |
| Pres Diff Bore-Annulus (MPa) | 8.28 |
| Pres Diff Piston-Annulus (MPa) | 3.10 |

Figure 4:
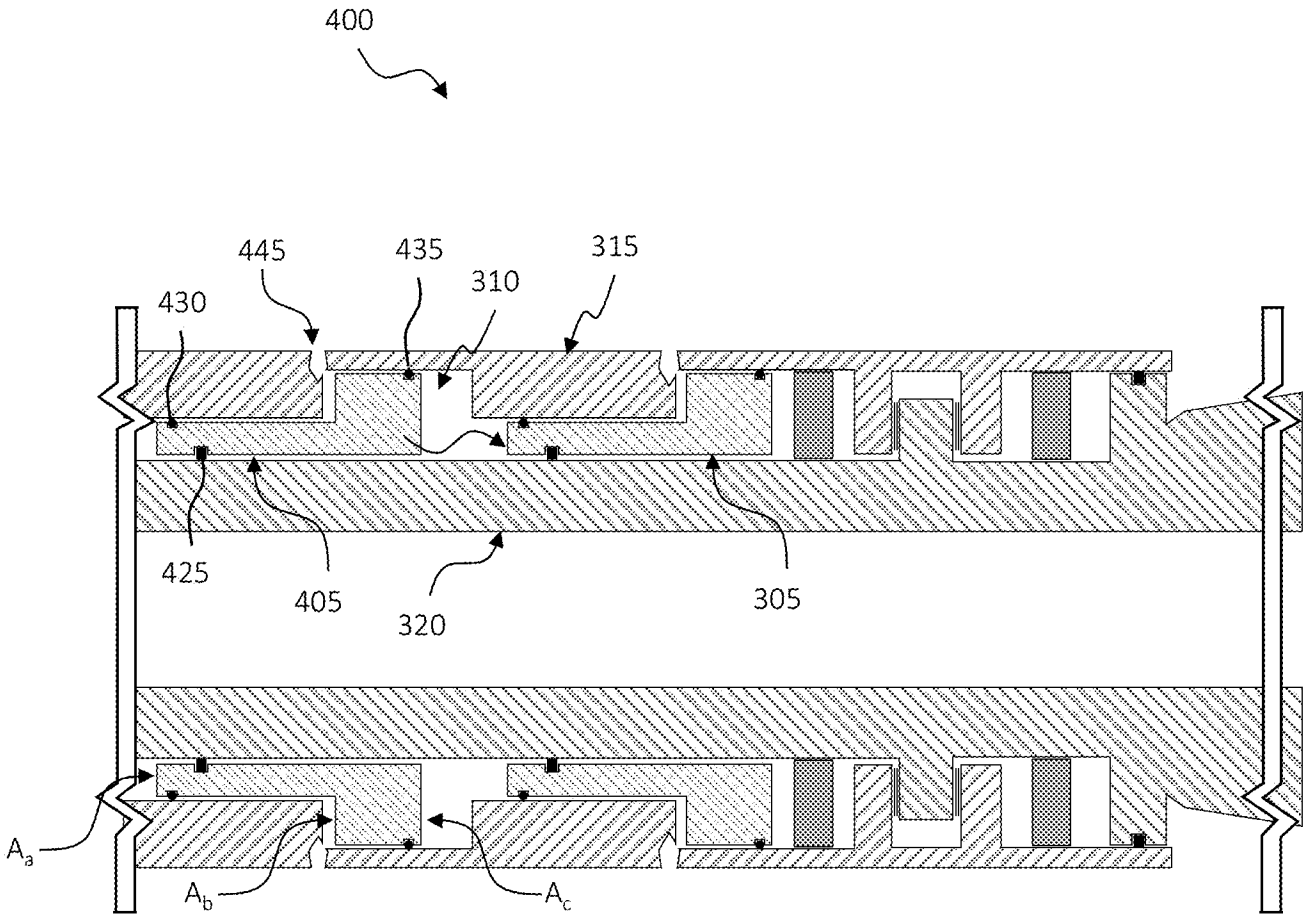
FIG. 4 depicts another embodiment of a rotary seal assembly according to one or more other principles of the disclosure.

Referring to FIG. 4, depicted is another embodiment of a rotary seal assembly 400 according to principles of the disclosure. The rotary seal assembly 400 is similar in many respects to the rotary seal assembly 300 of FIG. 3. Accordingly, like reference numbers have been used to reference similar, if not identical, features. The rotary seal assembly 400 differs, for the most part, from the rotary seal assembly 300, in that the rotary seal assembly 400 includes a second pressure compensation piston 460 positioned within the cavity 310 between the housing 315 and the rotatable shaft 320. The second pressure compensation piston 405 may be a stepped piston similar to pressure compensation piston 305 and may be configured to slide longitudinally with respect to the housing 315. In this embodiment, the second pressure compensation piston 405 may be positioned uphole of the pressure compensation piston 305. At least a first and second linear dynamic seal 430 and 435 may similarly be positioned between the second pressure compensation piston 405 and the housing 315.

In some embodiments, there may be a third dynamic rotary seal 425 positioned along a radial surface of the opening of the second pressure compensation piston 405 for sealing the second pressure compensation piston 405 relative to the rotatable shaft 320. In some embodiments, the housing 315 may include a second annulus pressure port 445 therein, wherein the second annulus pressure port 445 may be configured to couple a pressure source outside of the housing 315 proximate to a stepped up area A2 of the second pressure compensation piston 405.

Table 2 included herein provides an example of sample calculations showing pressure and force calculations for the rotary seal assembly 400 including a second pressure compensation piston 405. Referring to the column in Table 2 showing the combined pressures with Piston 1+Piston 2, which is the combination of the pressure compensation piston 305 and the second pressure compensation piston 405. Table 2 illustrates how adding one or more additional pressure compensation pistons may provide further reduction of pressure differential across the first dynamic rotary seal 325 and the third rotary seal 425. Thus, whereas the pressure differential across the rotary seal 325 would have been 8.28 MPa without the stepped pressure compensation piston 305 and stepped pressure compensation piston 405, the inclusion of the first stepped pressure compensation piston 305 and second pressure compensation piston 405 reduces the pressure differential across the third rotary seal 425 to 3.10 MPa and first rotary seal 325 to 1.16 MPa.

TABLE 2

Example of pressure calculations with a first and second pressure compensation piston:

| | Piston 1 | Piston 1 + Piston 2 |
|---|---|---|
| Bore Pressure (MPa) | 172.41 | 167.24 |
| Annulus Pressure (MPa) | 164.14 | 164.14 |
| Tool Pressure Drop (MPa) | 8.28 | 3.10 |
| Diameter A ($D_0$)(cm) | 2.54 | 2.54 |
| Diameter B ($D_1$)(cm) | 5.08 | 5.08 |
| Diameter C ($D_2$)(cm) | 7.62 | 7.62 |
| Area A ($A_A$)($cm^3$) | 15.19 | 15.19 |
| Area B ($A_B$)($cm^3$) | 25.32 | 25.32 |
| Area C ($A_C$)($cm^3$) | 40.52 | 40.52 |
| Force 1 (Bore Pressure) | 2620 | 2541 |
| Force 2 (Annulus Pressure) | 4156 | 4156 |
| Force 3 (F1 + F2) | 6776 | 6697 |
| Pressure at Piston (MPa) | 167.24 | 165.30 |
| Pres Diff Bore-Piston (MPa) | 5.17 | 1.94 |
| Pres Diff Bore-Annulus (MPa) | 8.28 | 3.10 |
| Pres Diff Piston-Annulus (MPa) | 3.10 | 1.16 |

Aspects disclosed herein include:

A. Provided is a pressure compensation piston for use with a rotary seal assembly, the pressure compensation piston including: 1) a stepped piston having an opening extending there through for positioning the stepped piston about a rotatable shaft of a rotary seal assembly; and 2) a rotary seal positioned along a radial surface of the opening for sealing the stepped piston relative to the rotatable shaft.

B. A rotary seal assembly, the rotary seal assembly including: 1) a housing; 2) a rotatable shaft positioned in a longitudinal opening in the housing, the housing and rotatable shaft forming a cavity there between; and 3) a pressure compensation piston positioned in the cavity, the pressure compensation piston including: a) a stepped piston having an opening extending there through for positioning the stepped piston about the rotatable shaft; and b) a rotary seal positioned along a radial surface of the opening for sealing the stepped piston relative to the rotatable shaft.

C. A well system, the well system including: 1) a wellbore located within a subterranean formation; 2) a rotary seal assembly positioned in the wellbore via a conveyance, the rotary seal assembly including: a) a housing; b) a rotatable shaft positioned in a longitudinal opening in the housing, the housing and rotatable shaft forming a cavity there between; and c) a pressure compensation piston positioned in the cavity, the pressure compensation piston including: i) a stepped piston having an opening extending there through for positioning the stepped piston about the rotatable shaft; and ii) a rotary seal positioned along a radial surface of the opening for sealing the stepped piston relative to the rotatable shaft.

Aspects A, B, and C may have one or more of the following additional elements in combination: Element 1: wherein the opening includes a diameter ($D_0$) and a circumferential profile extending radially outward into the stepped piston, the rotary seal positioned within the circumferential profile. Element 2: wherein the stepped piston includes a first diameter ($D_1$) portion and a second greater diameter ($D_2$) portion, and further wherein the circumferential profile is located in the first diameter ($D_1$) portion. Element 3: further including one or more linear dynamic seals for sealing the stepped piston relative to a housing surrounding the pressure compensation piston. Element 4: wherein a first linear dynamic seal is positioned at least partially within a radially exterior surface of the first diameter ($D_1$) portion to seal the first diameter ($D_1$) portion relative to the housing, and further wherein a second linear dynamic seal is positioned at least partially within a radially exterior surface of the second diameter ($D_2$) portion to seal the second diameter ($D_2$) portion relative to the housing. Element 5: further comprising an annulus pressure port in the housing, the annulus pressure port configured to couple a pressure source outside of the housing to a stepped up area of the stepped piston. Element 6: wherein the opening includes a diameter ($D_0$) and a circumferential profile extending radially outward into the stepped piston, the rotary seal positioned within the circumferential profile. Element 7: wherein the stepped piston includes a first diameter ($D_1$) portion and a second greater diameter ($D_2$) portion, and further wherein the circumferential profile is located in the first diameter ($D_1$) portion. Element 8: further comprising one or more linear dynamic seals for sealing the stepped piston relative to a housing surrounding the pressure compensation piston. Element 9: wherein a first linear dynamic seal is positioned at least partially within a radially exterior surface of the first diameter ($D_1$) portion to seal the first diameter ($D_1$) portion relative to the housing, and further wherein a second linear dynamic seal is positioned at least partially within a radially exterior surface of the second diameter ($D_2$) portion to seal the second diameter ($D_2$) portion relative to the housing. Element 10: wherein the rotary seal is a first rotary seal, and further including a second rotary seal positioned proximate and between an outer radial surface of the rotatable shaft and an inner radial surface of the longitudinal opening for sealing the rotatable shaft relative to the housing. Element 11: wherein the circumferential profile is a first circumferential profile, and further including a second circumferential profile extending radially inward into the rotatable piston, the second rotary seal positioned within the second circumferential profile. Element 12: wherein the pressure compensation piston is a first pressure compensation piston positioned in the cavity, and further including a second pressure compensation piston positioned in the cavity, the second pressure compensation piston including a second stepped piston having a second opening extending there through for positioning the second stepped piston about the rotatable shaft, and a third rotary seal positioned along a radial surface of the second opening for sealing the second stepped piston relative to the rotatable shaft. Element 13: further including a radial bearing positioned within the cavity. Element 14: wherein the pressure compensation piston is positioned uphole in the cavity relative to the radial bearing. Element 15: further including a thrust bearing positioned within the cavity. Element 16: further comprising a second radial bearing positioned within the cavity and downhole of the thrust bearing. Element 17: wherein the pressure compensation piston and the housing are rotationally fixed relative to one another and are configured to rotate relative to the rotatable shaft.

Those skilled in the art to which this application relates will appreciate that other and further additions, deletions, substitutions and modifications may be made to the described embodiments.

What is claimed is:

1. A pressure compensation piston for use with a rotary seal assembly, comprising:

a stepped piston having an opening extending there through for positioning the stepped piston about a rotatable shaft of a rotary seal assembly, wherein the opening includes a diameter ($D_0$) and a circumferential profile extending radially outward into the stepped piston, and further wherein the stepped piston includes a first diameter ($D_1$) portion and a second greater diameter ($D_2$) portion, and further wherein the circumferential profile is located in the first diameter ($D_1$) portion;

a rotary seal positioned within the circumferential profile along a radial surface of the opening for sealing the stepped piston relative to the rotatable shaft;

a first linear dynamic seal positioned at least partially within a radially exterior surface of the first diameter ($D_1$) portion to seal the first diameter ($D_1$) portion relative to a housing surrounding the pressure compensation piston; and a second linear dynamic seal positioned at least partially within a radially exterior surface of the second diameter ($D_2$) portion to seal the second diameter ($D_2$) portion relative to the housing.

2. The pressure compensation piston according to claim 1, wherein the circumferential profile is located in the first diameter ($D_1$) portion.

3. A rotary seal assembly, comprising:

a housing;

a rotatable shaft positioned in a longitudinal opening in the housing, the housing and rotatable shaft forming a cavity there between; and a pressure compensation piston positioned in the cavity, the pressure compensation piston including:

a stepped piston having an opening extending there through for positioning the stepped piston about the rotatable shaft; and a rotary seal positioned along a radial surface of the opening for sealing the stepped piston relative to the rotatable shaft, the stepped piston having a first piston Area ($A_A$) configured to receive bore pressure from fluid within the housing, a second piston Area ($A_B$) configured to receive annulus pressure from outside the housing, and a third piston Area ($A_C$) isolated from the fluid within the housing and the fluid outside of the housing, and further wherein Area ($A_C$)>Area ($A_B$)>Area ($A_A$).

4. The rotary seal assembly according to claim 3, further comprising an annulus pressure port in the housing, the annulus pressure port configured to couple a pressure source outside of the housing to a stepped up area of the stepped piston.

5. The rotary seal assembly according to claim 3, wherein the opening includes a diameter ($D_0$) and a circumferential profile extending radially outward into the stepped piston, the rotary seal positioned within the circumferential profile.

6. The rotary seal assembly according to claim 5, wherein the stepped piston includes a first diameter ($D_1$) portion and a second greater diameter ($D_2$) portion, and further wherein the circumferential profile is located in the first diameter ($D_1$) portion.

7. The rotary seal assembly according to claim 6, further comprising one or more linear dynamic seals for sealing the stepped piston relative to a housing surrounding the pressure compensation piston.

8. The rotary seal assembly according to claim 7, wherein a first linear dynamic seal is positioned at least partially within a radially exterior surface of the first diameter ($D_1$) portion to seal the first diameter ($D_1$) portion relative to the housing, and further wherein a second linear dynamic seal is positioned at least partially within a radially exterior surface of the second diameter ($D_2$) portion to seal the second diameter ($D_2$) portion relative to the housing.

9. The rotary seal assembly according to claim 5, wherein the rotary seal is a first rotary seal, and further including a second rotary seal positioned proximate and between an outer radial surface of the rotatable shaft and an inner radial surface of the longitudinal opening for sealing the rotatable shaft relative to the housing.

10. The rotary seal assembly according to claim 9, wherein the circumferential profile is a first circumferential profile, and further including a second circumferential profile extending radially inward into the stepped piston, the second rotary seal positioned within the second circumferential profile.

11. The rotary seal assembly according to claim 9, wherein the pressure compensation piston is a first pressure compensation piston positioned in the cavity, and further including a second pressure compensation piston positioned in the cavity, the second pressure compensation piston including:

a second stepped piston having a second opening extending there through for positioning the second stepped piston about the rotatable shaft; and a third rotary seal positioned along a radial surface of the second opening for sealing the second stepped piston relative to the rotatable shaft.

12. The rotary seal assembly according to claim 3, further including a radial bearing positioned within the cavity.

13. The rotary seal assembly according to claim 12, wherein the pressure compensation piston is positioned uphole in the cavity relative to the radial bearing.

14. The rotary seal assembly according to claim 13, further including a thrust bearing positioned within the cavity.

15. The rotary seal assembly according to claim 14, further comprising a second radial bearing positioned within the cavity and downhole of the thrust bearing.

16. The rotary seal assembly according to claim 3, wherein the pressure compensation piston and the housing are rotationally fixed relative to one another and are configured to rotate relative to the rotatable shaft.

17. A well system, comprising:

a wellbore located within a subterranean formation;

a rotary seal assembly positioned in the wellbore via a conveyance, the rotary seal assembly including:

a housing;

a rotatable shaft positioned in a longitudinal opening in the housing, the housing and rotatable shaft forming a cavity there between; and a pressure compensation piston positioned in the cavity, the pressure compensation piston including:

a stepped piston having an opening extending there through for positioning the stepped piston about the rotatable shaft; and a rotary seal positioned along a radial surface of the opening for sealing the stepped piston relative to the rotatable shaft, the stepped piston having a first piston Area ($A_A$) configured to receive bore pressure from fluid within the housing, a second piston Area ($A_B$) configured to receive annulus pressure from outside the housing, and a third piston Area ($A_C$) isolated from the fluid within the housing and the fluid outside of the housing, and further wherein Area ($A_C$)>Area ($A_B$)>Area ($A_A$).

* * * * *